United States Patent [19]

Knudtson

[11] 4,149,283

[45] Apr. 17, 1979

[54] TOILET WITH SELECTIVE VOLUME FLUSH

[75] Inventor: Vernon E. Knudtson, Madison, Wis.

[73] Assignee: Calisto Corporation, Madison, Wis.

[21] Appl. No.: 827,975

[22] Filed: Aug. 26, 1977

[51] Int. Cl.[2] ..... E03D 1/14

[52] U.S. Cl. ..... 4/324; 4/325; 4/249

[58] Field of Search ..... 4/10, 67 R, 67 A, 34, 4/37, 57 R, 57 P, 249

[56] References Cited

U.S. PATENT DOCUMENTS

| | | | |
|---|---|---|---|
| 3,029,443 | 4/1962 | Naccarato | 4/DIG. 3 |
| 3,662,408 | 5/1972 | Knudtson | 4/67 R |
| 4,011,605 | 3/1977 | Karlsson et al. | 4/249 X |

*Primary Examiner*—Henry K. Artis
*Attorney, Agent, or Firm*—Keith Schoff

[57] ABSTRACT

A toilet flushing mechanism is described which embodies water conserving dual modes of operation providing either a full tank volume water flush or a partial flush. Selective manipulation of the toilet tank handle provides different dwell times for an air valve to remain open and causes alteration in the elapsed time required for a buoyant tank drain valve to seat so that the volume of water which drains from the tank during each cycle is altered.

5 Claims, 2 Drawing Figures

TOILET WITH SELECTIVE VOLUME FLUSH

FIELD OF INVENTION

In a water flush, syphon action toilet, the toilet bowl is sealed by a water trap from communicating air passage with the sewer to which the toilet is plumbed. An elevated flush tank equipped with a water level controller may be provided in conventional manner to refill the tank when it is drained during a flush cycle. The drain valve for the tank may be manually opened through use of mechanical linkage enabling the tank to be drained by gravity flow into the toilet bowl and initiate syphoning action and removal from the toilet bowl of the contents into the sewer.

BACKGROUND OF THE INVENTION

A toilet tank mechanism embodying a time delayed air valve closing operator is described in U.S. Pat. No. 3,662,408 issued May 16, 1972 to Vernon E. Knudtson.

SUMMARY OF THE INVENTION

A hollow, ported, and bottom vented free-floating check valve member is disposed within a toilet tank to seat upon the tank drain opening and to be elevationally raised within the confines of an open bottomed vessel fixed within the toilet tank. The valve member is seated or is raised to open the drain valve in response to the differential of fluid forces acting upon the valve member. The valve member buoyancy varies according to internal water flooding or evacuation and the fluid pressure environment external to the buoyancy which is subject to change in accordance with the level of water within the toilet tank and the pressure of air within the vessel surrounding the valve member. Raising or lowering of the water level in the tank by refilling or draining the tank during a flush cycle causes air within the vessel, while the vessel is partially submerged, to undergo, respectively, compression or rarification. Opening of an air valve communicating the air within the vessel to atmosphere equalizes the pressure within the vessel with atmosphere and affects bouyancy of the valve member. Selective manual modes providing different open dwell time settings for the air valve change the fluid pressure environment of the valve member with prolonged dwell time opening for the air valve abbreviating the elapsed time required for seating of the valve member, resulting in only partial drainage of the tank during a flush cycle and water conservation. Momentary opening of the air valve results in the tank being completely drained during a flush cycle.

DESCRIPTION OF THE INVENTION

Figure 1:
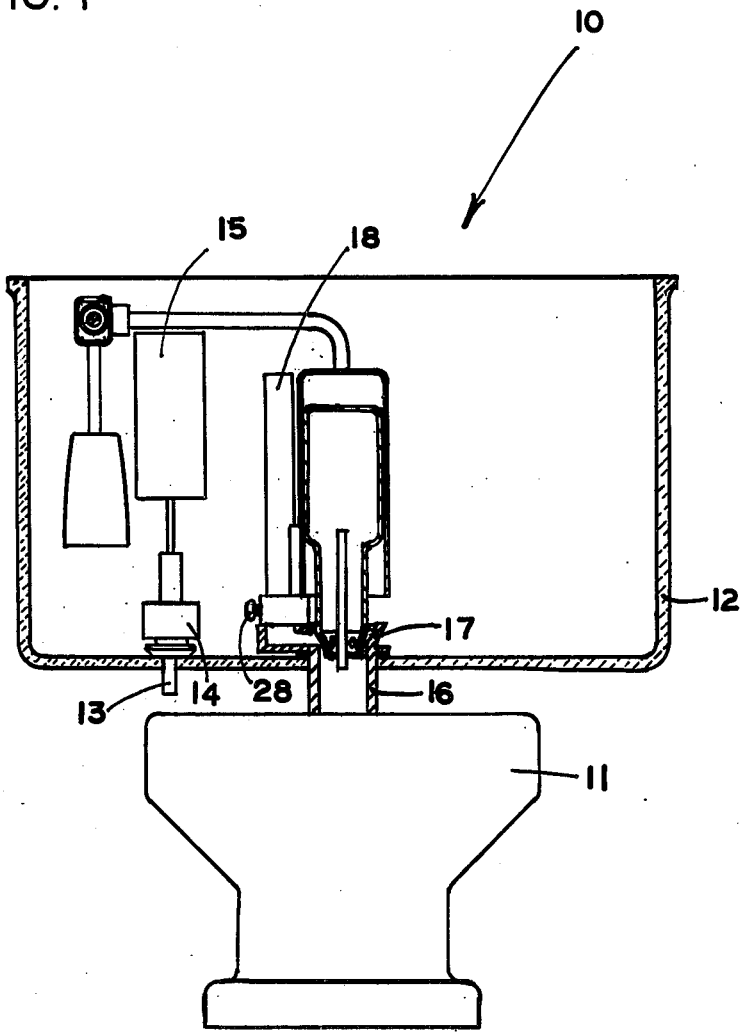
FIG. 1 is a front elevation in partial cross-section of a water flush toilet fitted with a preferred embodiment of the flushing mechanism of this invention.

Referring to FIG. 1, syphon action toilet 10 is shown with base fixture 11 comprising the bowl supporting flush tank 12. Pressurized water supply pipe 13 is plumbed into tank 12 and is equipped with water supply valve 14. Float controlled operator 15 is operably fitted to valve 14 to bias the valve closed when the level of water within tank 12 reaches a prescribed fill level and to bias valve 14 open when the water level in tank 12 drops. Tank drain fitting 16 is provided configured with collar portion 17 chamfered to provide a conical annular seating surface. Integral overflow pipe 18 extends from the base of tank 12 to above the water fill level of the tank for protecting against overflowing of water from tank 12 by providing a safety outlet into fitting 16 below collar portion 17. A supplementary water line from valve 14 which empties into overflow pipe 18 may be provided in conventional manner, but is not shown. All of the means described in this paragraph are conventional and comprise no part of this invention.

Figure 2:
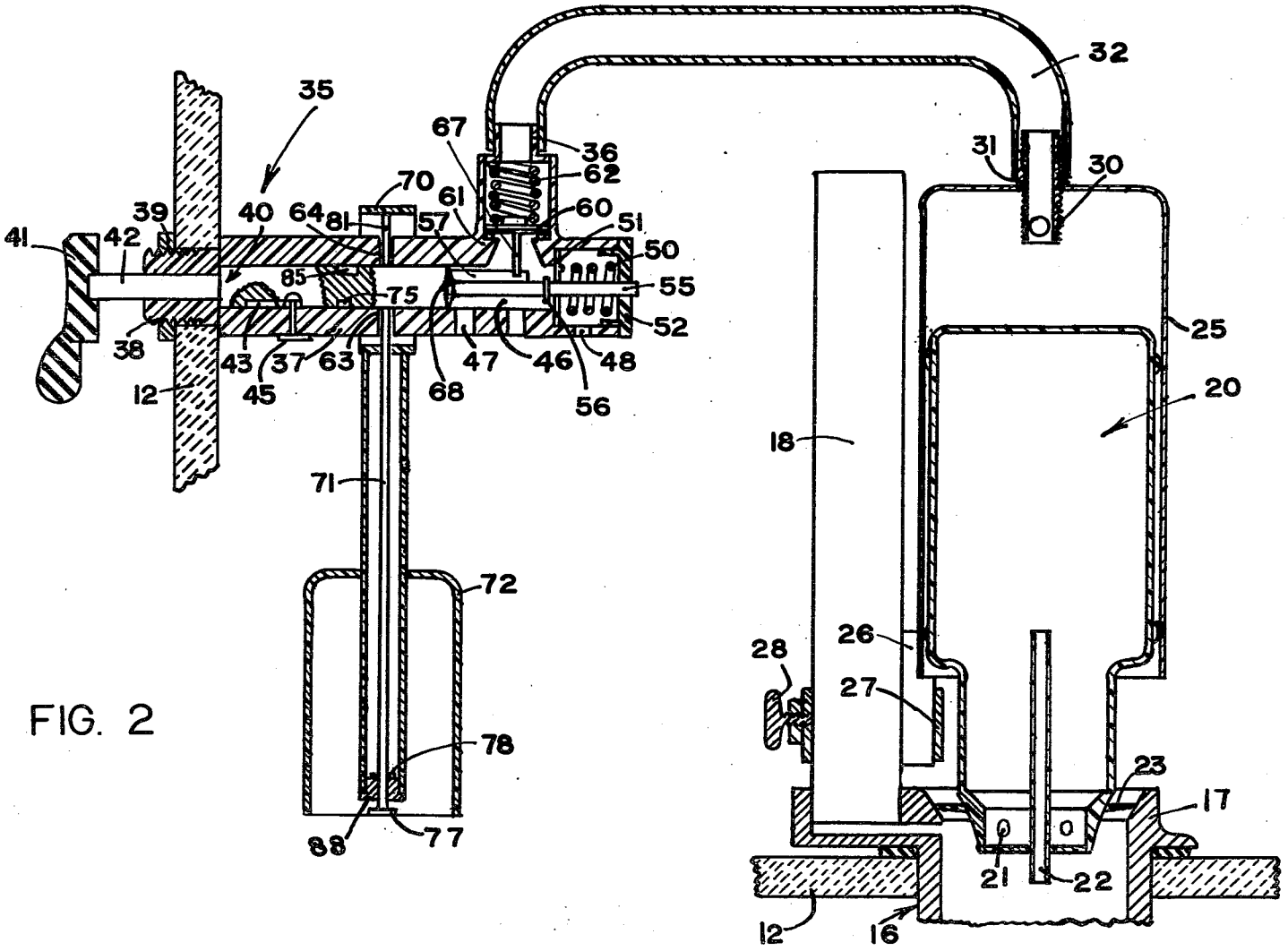
FIG. 2 is a cross-sectional elevation of the flushing mechanism of FIG. 1.

Referring to FIGS. 1 and 2, bouyant drain check valve member 20 is disposed to operably seat on collar 17 of drain fitting 16. Valve member 20 is of bulbous, hollow configuration and is provided with ports 21, which as shown are multiple in number but may consist of but a single port opening into the lower portion of the member, and is additionally provided with tube 22 communicating the internal volume of the member above the basemost portion which may be water flooded, with external environment below the base of the valve member, a region which is occupied by air when valve member 20 is seated and may be occupied by air in a water vortex when the drain is open and water is draining from tank 12. Gasket 23 comprising resilient material preferably, is fitted on the base of valve member 20 to effect an operable water seal on collar 17 when the tank drain is closed.

Vessel 25 is shown cylindrically bell shaped with an open bottom and closed top in which hollow stud 30 and accompanying nipple 31 for tubing connection are shown. Vessel 25 depends in tank 12 to surround a portion of valve member 20 and may be elevationally adjusted and centered over valve member 20 and the drain opening in fitting 16 by means of stud 26 which depends below and beyond the perimeter of the vessel for being secured in ring clamp 27 which is fitted about overflow pipe 18 and is tightened by thumb screw 28. Thus, by rotationally adjusting stud 26 both about its own axis and also along the periphery of overflow pipe 18, vessel 25 may be precisely centered over check valve 20.

Air valve 35 is shown provided with nipple 36 to which tube 32 is connected at one end, the other end being connected to nipple 31 on vessel 25. Valve body 37 comprises barrel cavity 46 and is disposed with one end portion provided with threads 38 projecting through an opening in tank 12 where it is secured by threaded nut 39, engaged on threads 38, being tightened against the face of tank 12. Bolt 40 is biasable rotationally and axially within cavity 46 by manipulation of handle 41, which is fixed to protruding shaft portion 42 of bolt 40. Guideway slot 43 in bolt 40 receives guide pin 45 protruding radially inward from valve body 37 and is configured axially extending along bolt 40 a distance clearly shown in FIG. 2 and also through a circumferential arc partially around bolt 40 at the inboard end of the axial portion of the slot for restricting the angular position of bolt 40 during push-pull axial biasing and for restricting the translational position of bolt 40 during rotational biasing of the bolt by manual actuation of handle 41. Helical compression spring 50 is received in an enlarged inboard end portion of cavity 46 and is secured within valve body 37 by end cap 52 which may be affixed to valve body 37 by threaded connection or other operable means. Annular spring thruster 51 provides for axial biasing of spring 50 by being engaged by snap ring 56 operably fitted on stem 55 of bolt 40. Key 57 is integral with bolt 40 extending longitudinally of stem 55 as a radial vane, positioned to traverse in an arcuate sweep the upper inboard portion of cavity 46 when handle 41 is rotationally manipulated. Air valve member 60 is disposed for being operably lodged on valve seat 61 of valve body 37 and is configured with depending stem 67 which can be contacted and displaced to unseat valve member 60 from valve seat 61 either by key 57 when bolt 40 is operably rotated or by shoulder 68 of bolt 40 when the bolt is axially biased. Compression spring 62 loads valve member 60 causing it to effect return rotation of bolt 40 and re-seating of valve member 60 upon release of manual rotational actuation of bolt 40. A similar function is performed by spring 50 when bolt 40 is axially biased. Unseating of valve member 60 communicates the confines of vessel 25 to cavity 46 of air valve 35, which by means of ports 47 and 48 is vented to atmosphere. A single vent opening is sufficient if placed where it is not covered by biasing of bolt 40.

Bolt locking operator 70 is configured as an annular ring surrounding valve body 37 of air valve 35, with a depending open bottomed float portion 72. Diametrically opposed vertical openings 63 and 64 provided in valve body 37 receive respectively, free-falling pin 71 and fixed pin 81 of operator 70. Pin 71 is provided with head 77 at its base extremity and with operably attached snap ring 78 thereabove. Annular thruster 88 fixed to operator 70 is disposed about pin 71 to move freely between head 77 and snap ring 78 on pin 71.

In operation, tank 12 may be filled with water in operable manner and bolt 40 of air valve 35 may be disposed in unactuated position as shown in FIG. 2. Toilet flushing actuation may be accomplished in either of two ways, either by rotating handle 41 or by pushing handle 41 inward toward toilet tank 12. In the rotational mode of actuation, the rotational traverse of key 57 contacts and displaces stem 67 to unseat valve member 60. The handle turning operation is momentary and upon release of handle 41, spring 62 acts to return-rotate handle 41 and bolt 40, and valve member 60 is re-seated on valve seat 61. During the period that valve member 60 is unseated there is communication between the confines of vessel 25 and atmosphere, so that super-atmospheric pressure within vessel 25, caused by water rising within tank 12 to fill it compressing air trapped within the vessel, is relieved and check valve member 20 immediately rises under buoyant force from drain fitting 16, opening the drain and enabling water to flow by gravity from tank 12 into bowl fixture 11. During the time that tank 12 is draining, check valve member 20 is partially flooded by water entering through ports 21 and air displaced by the water flooding is vented through tube 22. Loss of buoyancy of valve member 20 effected by such flooding is insufficient, however, to fully overcome the increase in the buoyancy of the member effected by a partial vacuum being created within vessel 25 by sinking of member 20 in the lowering water in tank 12. When the level of the draining water drops below the skirt of vessel 25, the partial vacuum existing therein is broken, decreasing the buoyancy of valve member 20 and causing it to operably seat. Water then refills tank 12 until fill valve 14 is shut by action of float operator 15.

In the alternate mode of operation, that of pushing actuation of handle 41, stem 67 is displaced by contact with shoulder 68 of bolt 40 to unseat valve member 60. The translational displacement of bolt 40 places recess 75 in bolt 40 in alignment with pin 71 and under the urging of buoyant float portion 72 of bolt locking operator 70, pin 71 engages recess 75 thus obstructing further movement of bolt 40. The urging of spring 50 on bolt 40 causes there to be some frictional binding of pin 71 in recess 75 so that as the level of water recedes in tank 12 (the drain valve having opened in the same manner as previously described for the rotational mode of handle actuation) bolt locking operator 70 is lowered as portion 72 floats lower until head 77 of pin 71 carries some of the gravitational weight of operator 70. When sufficiently loaded, pin 71 is pulled downward clearing recess 75, but simultaneously with the abrupt dropping of operator 70 occasioned by the weight supported by pin 71 being added, fixed pin 81 engages recess 85 thus retaining bolt 40 in position. Communication between atmosphere and the confines of vessel 25 remains open and water flooding of the interior of check valve member 20 is sufficient to cause member 20 to sink, in the absence of a vacuum being drawn in vessel 25, and seat upon drain fitting 16 thus abbreviating the flush cycle while the level of water in tank 12 is above the bottom of the skirt of vessel 25. As tank 12 is being refilled with water from supply valve 14, operator 70 again resumes floating as portion 72 becomes immersed in the rising water and pin 81 is gradually lifted from recess 85 in bolt 40 enabling the bolt to be returned to unactuated position as shown in FIG. 2 under urging of spring 50. Valve member 60 is simultaneously seated to interrupt communicating air passage between vessel 25 and atmosphere. With continuing rise in the water level, thruster 88 engages snap ring 78 and provides buoyant loading for pin 71 which will cause it to operably engage and retain bolt 40 when the bolt is again actuated for the partial flush mode of operation.

The use of the valve of this invention as a toilet flush valve has been described, but the use of the valve as a regulating valve in other applications requiring a liquid level controller is obvious. Design adaptations in the valve will also be obvious such as re-locating valve closure member 60 and valve seat 61 co-axially within cavity 46 for operable loading by spring 50 so as to eliminate spring 62. In such an arrangement stem portion 55 may be foreshortened and stem 67 of valve closure member 60 may be disposed parallel in radially offset position from the axis of cavity 46 for being operably biased by key 57 and shoulder 68 in the manner hereinbefore described. If desired, two buoyant members may be provided, one each for pin 71 and pin 81 or other similar projection, replacing the single operator 70. Also, float portion 72 may be eliminated and replaced with a cup portion of inverted design and be compensated with counterbalancing spring means provided in obvious manner for providing functional operation. Alternate manners of venting check valve member 20 may be provided such as by providing a flexible tube connection through the wall of vessel 25 or by running a tube co-axially with tube 32. It is also possible to provide separate and independent air valves 35 for vessel 25 and check valve member 20 thereby providing greater flexibility of operation and control. The level to which water in tank 12 recedes during the minimized or partial flush operational mode of actuation for air valve 35 is determined both by the air pressure within vessel 25 and within check valve member 20; the former may be regulated, in addition to the time and water level constants built into air valve 35, by the elevational setting of vessel 25 using adjustable placement of stud 26 under clamp 27. While the air pressure within check valve member 20 can only be regulated by a separate and independent air valve, which is not shown, the rate of water flooding of check valve member 20 is controlled by the setting of member 30 with flooding occuring more rapidly with submerged depth of check valve depth in water in tank 12, thus resulting in earlier seating of check valve member 20 and increased minimization of water usage during a flush cycle using the delayed valve closing mode of operation. The setting of threaded stud 30 and the elevational adjustment of vessel 25 may both be employed to provide a partial flush cycle of desired volume for a syphon action toilet of any particular design.

I claim:

1. A regulating valve having plural modes of actuation for selecting valve closing time response setting, comprising, a. a valve body configured with a seat, b. a closure member disposed to sealably engage said seat, c. a resilient loading means disposed to sealably engage said closure member with said seat, d. a bolt member received in said valve body for being biased to contact and dislodge said closure member from sealing engagement with said seat, thereby opening said valve, said bolt member comprising at least one locking aperture, e. buoyantly actuated locking means configured with at least one projection for being engaged in one said locking aperture by elevational biasing, f. a pin supported for free elevational movement by said locking means for effecting reversibly removable engagement of said pin with one said locking aperture in said bolt member, g. actuating means for alternative rotational and translational biasing of said bolt member to effect operably either non-alignment of both said projection and said pin with one said aperture by rotational biasing thereby to implement immediate closing time response of said regulating valve, or to effect sequential engagement of said pin and said projection with at least one said locking aperture of said bolt member, thereby to implement delayed closing time response of said regulating valve, said sequential engagement being effected first by buoyant upward biasing of said locking means to engage said pin in one said aperture, and then downward gravity biasing of said locking means upon buoyancy being lost to further cause engagement of said projection with one said aperture and then disengagement of said pin by further downward biasing, and finally with recovery of buoyancy, disengagement of said projection thereby freeing said bolt from locking engagement.

2. The apparatus of claim 1 wherein said locking apertures comprise at least two bores disposed substantially axially transverse of the axis of said bolt member, and disposed for being operably engaged by said projection and said pin.

3. The apparatus of claim 1 wherein said buoyantly actuated locking means is configured with a float portion disposed for at least partial immersion in liquid and wherein said pin is disposed to depend below said bolt member and is supported for limited elevational movement independent of said locking means.

4. The apparatus of claim 1 wherein said actuating means for said bolt member is biasable to move said bolt member either rotationally or translationally within said cavity and wherein in one manner of movement at least said one bore is aligned with said pin for operable engagement therewith by buoyant urging of said pin by said buoyantly actuated locking means and wherein another said bore is aligned with said projection for engagement therewith by gravitational urging of said buoyantly actuated locking means in substantially simultaneous movement with disengagement of said pin from said one bore.

5. The apparatus of claim 1 comprising in additional combination, a. a hollow vessel configured with a bottom opening adapted to be disposed at an elevation intermediate the greatest and the least levels of liquid which obtain when regulated by said valve, b. an enclosed passage means opening from the upper portion of said vessel and communicating to said regulating valve, c. a buoyant member disposed to extend upward into said vessel, said buoyant member being configured for being downwardly seated by pneumatic force created in said vessel by liquid rising and trapping gaseous phase in said vessel thereby providing superatmospheric pressure equal to the differential in hydrostatic pressure between the levels of liquid within and without said vessel, said buoyant member being configured to undergo liquid flooding and with the upper internal portion thereof being vented to atmosphere.

* * * * *